US005255587A

United States Patent [19]

Eichenberg et al.

[11] Patent Number: 5,255,587

[45] Date of Patent: Oct. 26, 1993

[54] SHEET CUTTING DIE PRESS

[76] Inventors: Robert J. Eichenberg; LaDorna E. Eichenberg, both of 17171 Daimler, Irvine, Calif. 92714

[21] Appl. No.: 880,575

[22] Filed: May 8, 1992

[51] Int. Cl.[5] ..... B26D 5/10; B26D 5/16

[52] U.S. Cl. ..... 83/628; 83/633; 83/824

[58] Field of Search ..... 83/628, 633, 127, 128, 83/541, 531, 824

[56] References Cited

U.S. PATENT DOCUMENTS

| | | | |
|---|---|---|---|
| 896,478 | 8/1908 | Stockman | 83/128 |
| 3,064,559 | 11/1962 | Treer | 83/628 X |
| 3,400,625 | 9/1968 | Wrona | 83/628 X |
| 3,667,334 | 6/1972 | Brunett | 83/633 X |
| 4,065,990 | 1/1978 | Edhlund | 83/628 X |
| 4,462,291 | 7/1984 | Schulz | 83/628 X |
| 4,638,731 | 1/1987 | Kato | 83/628 X |
| 4,761,988 | 8/1988 | Kato | 83/628 X |
| 4,763,551 | 8/1988 | Halff et al. | 83/628 X |

*Primary Examiner*—Rinaldi Rada
*Attorney, Agent, or Firm*—Hawes & Fischer

[57] ABSTRACT

The sheet cutting die press includes a handle fixed to a cylindrical shaft, the longitudinal axes of which is offset from the longitudinal axes of stub axles at either end of the shaft. Thus, as the handle is moved causing the shaft to rotate, it applies pressure through a pair of bearings to a pair of pillow blocks which in turn rests on the top surface of a top platen. A cover over the cylindrical shaft is fixed to the pillow blocks so that, as the handle is moved to a position to retract the platen, the pillow blocks are lifted by the cover.

11 Claims, 3 Drawing Sheets

SHEET CUTTING DIE PRESS

INTRODUCTION

The present invention relates to an improved press for receiving and actuating a sheet cutting die or similar article.

Dies have long been used to cut various patterns out of sheet material. The typical die consists of a steel blade, bent to define the outline of the shape desired to be cut, which blade is received in and supported by a panel, often simply a piece of wood. By placing this assembly on a sheet, or a series of sheets, and then pressing the die, the blade can be forced through the sheets to cut the desired pattern. Often the blade is protected by a foam rubber or similar covering over the panel, the thickness of this covering being sufficient to place the surface of the covering above the edge of the blade, the resiliency of the covering permitting the edge of the blade to be exposed beyond the surface of the covering by simply applying pressure to the die. The resilience of such a covering also assists in ejecting the cut sheet material from the die.

Various presses have been designed to receive and employ such dies to cut patterns from sheets. In general, one type of press is designed to apply uniform pressure over the entire area of the die, to force all portions of the steel blade through a sheet, or collection of sheets, simultaneously. Another type of press is designed to roll across the die, the bite of the roll forcing the edge or edges of the die's blade through an adjacent sheet or collection of sheets.

Whatever design such presses employ, they must meet certain requirements. It is essential that they operate to cut free from the sheet the entire pattern defined by the die. Cutting only part of the pattern, or cutting all of the pattern some of the time and only some of the pattern the remainder of the time, is simply unsatisfactory. They must be versatile; they should accept and operate satisfactorily with any of a variety of different dies, dies of different sizes and dies defining different shapes. They must also protect the sharpened edges of the die, so that the die may be used repeatedly to cut the patter it defines.

They should also be relatively simple to operate, permitting an unskilled operator to employ the press and a die to cut the desired patterns. They should be relatively rugged and durable, for very likely the press will be in use over an extended period of time. They should be light enough to be reasonably portable. Preferably they should require no adjustment by the user, but if they do require some adjustment, the adjustment should be simply effected and the press operable, even when somewhat misadjusted, to properly actuate a die to cut the desired pattern.

These are but some of the objectives for all such sheet cutting die presses; these and other objectives will be apparent to those skilled in this field from the following description of the present invention.

BRIEF SUMMARY OF THE INVENTION

The sheet cutting die press of the present invention employs an upper platen and a lower platen held and supported with respect to one another in a spaced, parallel relationship by an assembly permitting the platens to be moved toward and away from one another. The press incorporates means for moving the platens toward and away from one another. This means includes a rotatable cam member adjacent to, but spaced at variable distance from, a platen, the distance being determined by the rotational orientation of the cam member. A channel block is received between the cam member and the adjacent platen. Thus, as a cam member rotates, the channel block and its adjacent platen are driven towards the other platen. By placing a sheet cutting die and one or more sheets between the platens, the cam member may be actuated to cause the platens to move towards one another and the pattern defined by the die to be cut from the sheets.

Preferably the cam member is manually actuated; in the preferred embodiment a handle is fixed to the cam member, the handle being rotatable with the cam member to actuate the cam member. Also, preferably a cover overlies the cam member and is attached to the channel block, so that as the cam member rotates to move the channel block away from the platen, the cover holds the channel block adjacent to the cam member. The channel block may include a channel to receive the outer race of a bearing member which is in turn received on the cam member.

BRIEF DESCRIPTION OF THE DRAWINGS

The invention will be further described in connection with the accompanying drawings in which.

DETAILED DESCRIPTION

Figure 1:
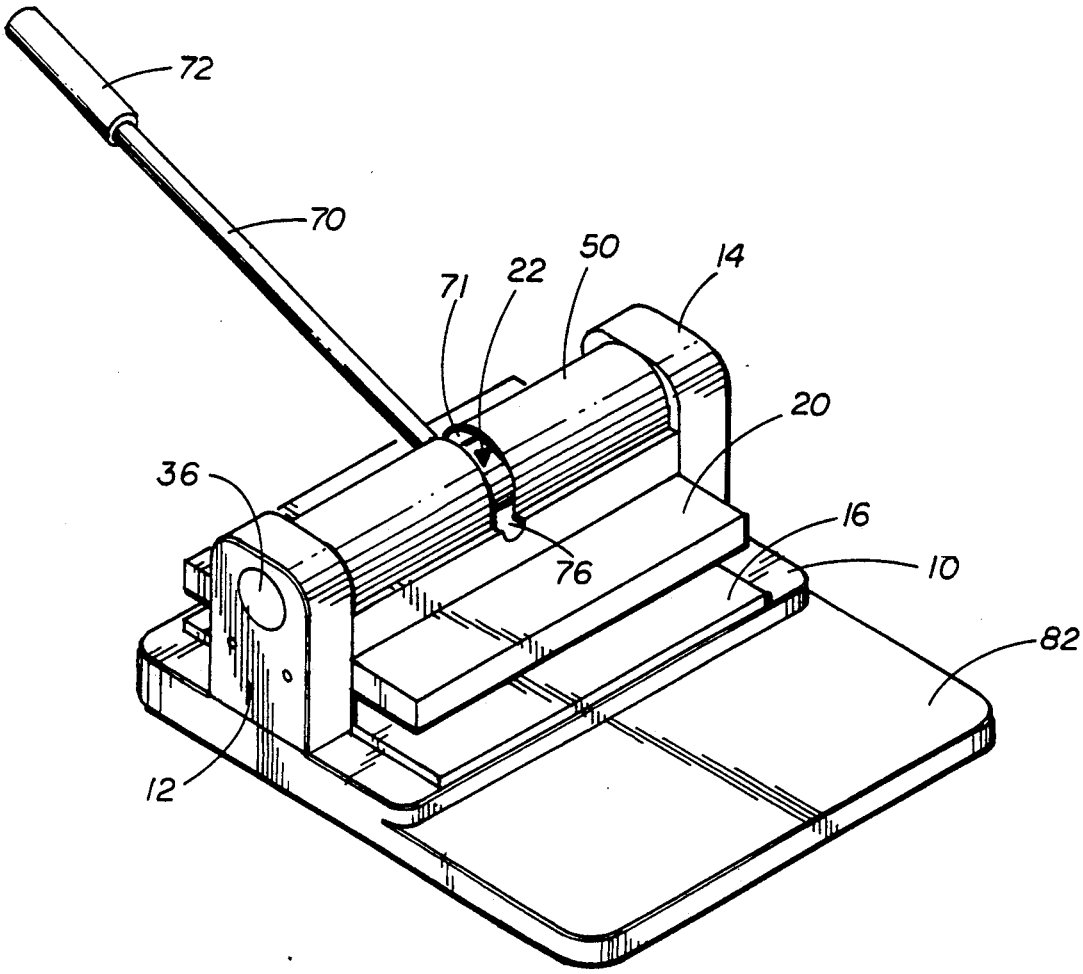
FIG. 1 is a perspective view of the preferred embodiment of the sheet cutting die press achieved by the present invention.

A preferred embodiment of the sheet cutting die press of the present invention is shown in perspective in FIG. 1. In general, it consists of a base 10 on which is mounted two side posts 12 and 14. A cutting pad or bottom platen 16 is attached to base 10, such as by screws, and spans the distance between the side posts. A pressure plate or top platen 20 is received between the side posts and is free to move up and down in an orientation parallel to the bottom platen. A drive mechanism 22, also received between the side posts, can be actuated to move the top platen towards and away from the bottom platen.

Figure 2:
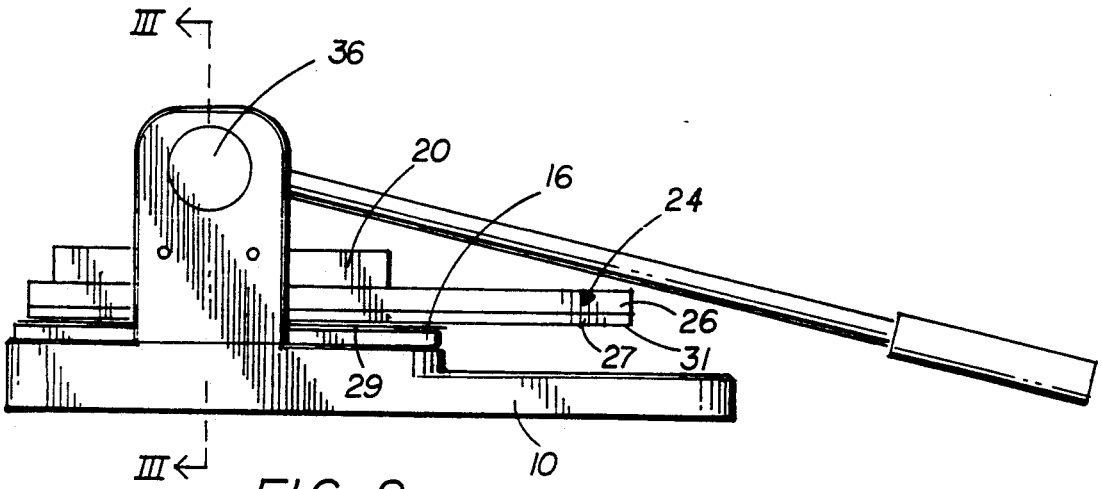
FIG. 2 is a side view of the press shown in FIG. 1.

As shown in FIG. 2, a sheet cutting die 24 may be placed between the top platen 20 and cutting pad 16 which is attached to the base 10. In general, this die consists of a wooden base 26 and a foam cover 27. A steel rule blade 28 (shown for example in cross-section in FIGS. 3 and 4) is received in the wooden base with its sharpened edge lying just below the outer surface of foam cover 27. By placing one or more sheets of material 29 adjacent to surface 31 of the foam cover 27 of the die, and by placing this assembly between the two platens of the press and then actuating the drive mechanism of the press as shown in FIG. 2, the sharpened edge of the steel rule blade of the die may be forced through the sheet or sheets 29 to cut out the shape defined by the die. The cutting pad 16, preferably of a material such as PVC, may be engaged by the sharpened edge of the blade after it passes through the sheets being cut, and will not dull that edge so that the die may be used repeatedly without resharpening.

Figure 3:
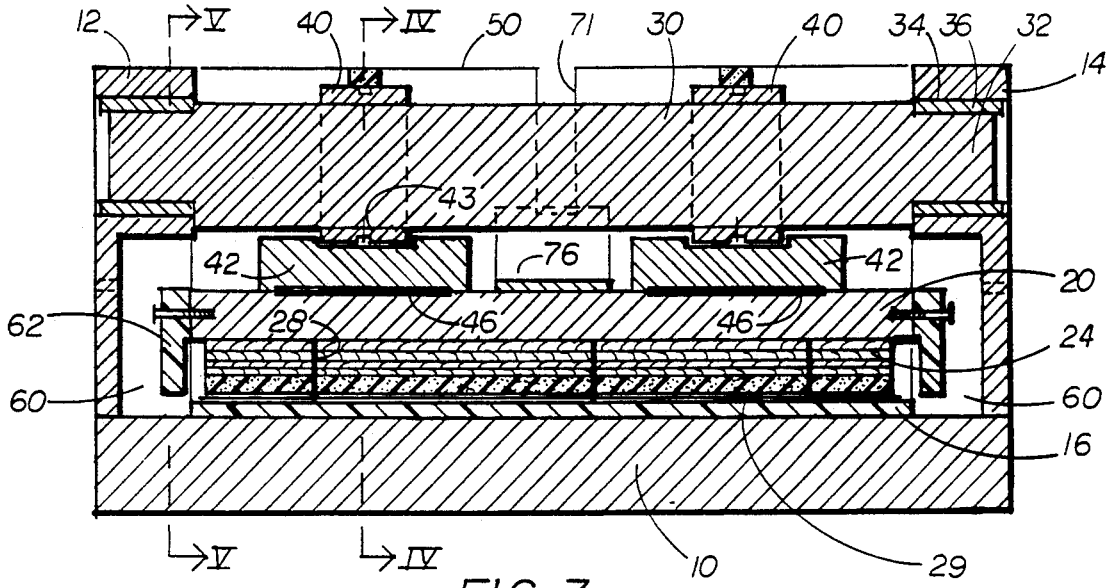
FIG. 3 is a vertical cross-sectional view of the press taken on lines III—III of FIG. 2.
Figure 4:
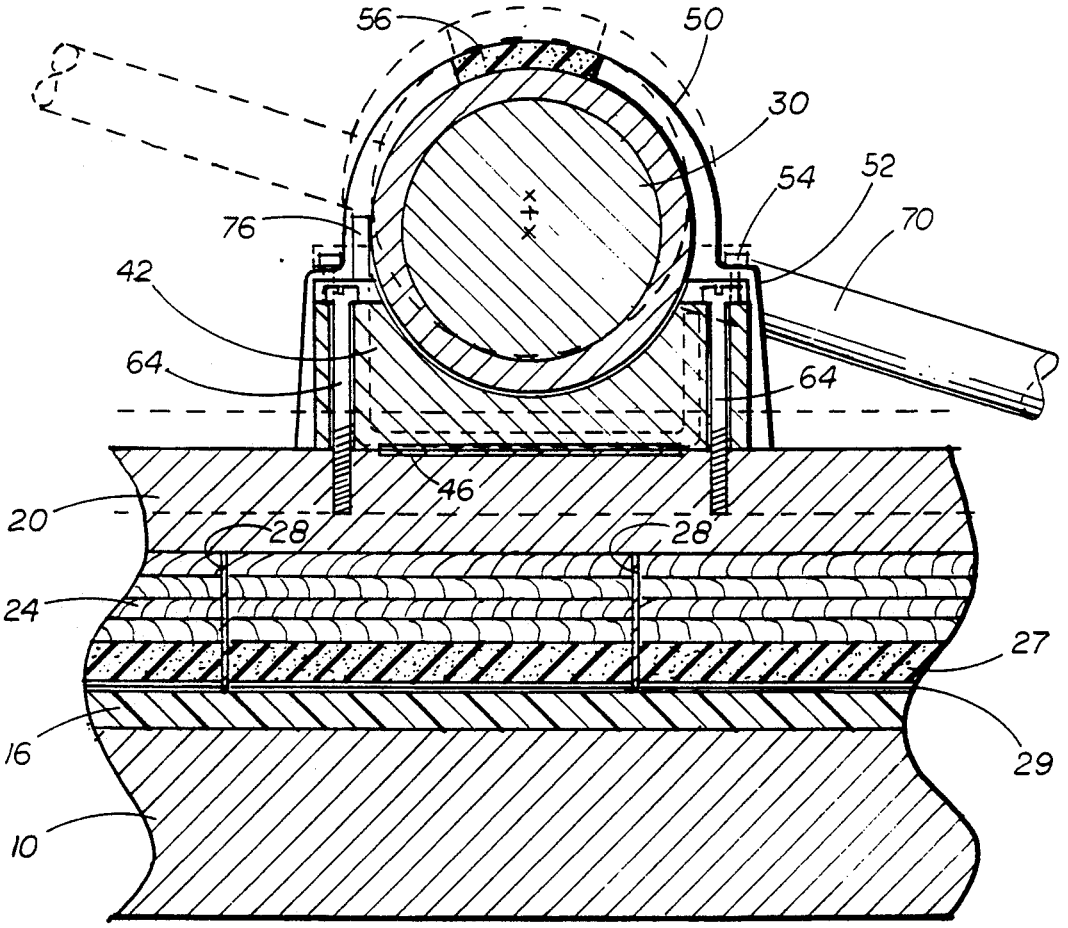
FIG. 4 is a vertical cross-sectional view of the press taken on lines IV—IV of FIG. 3.
Figure 5:
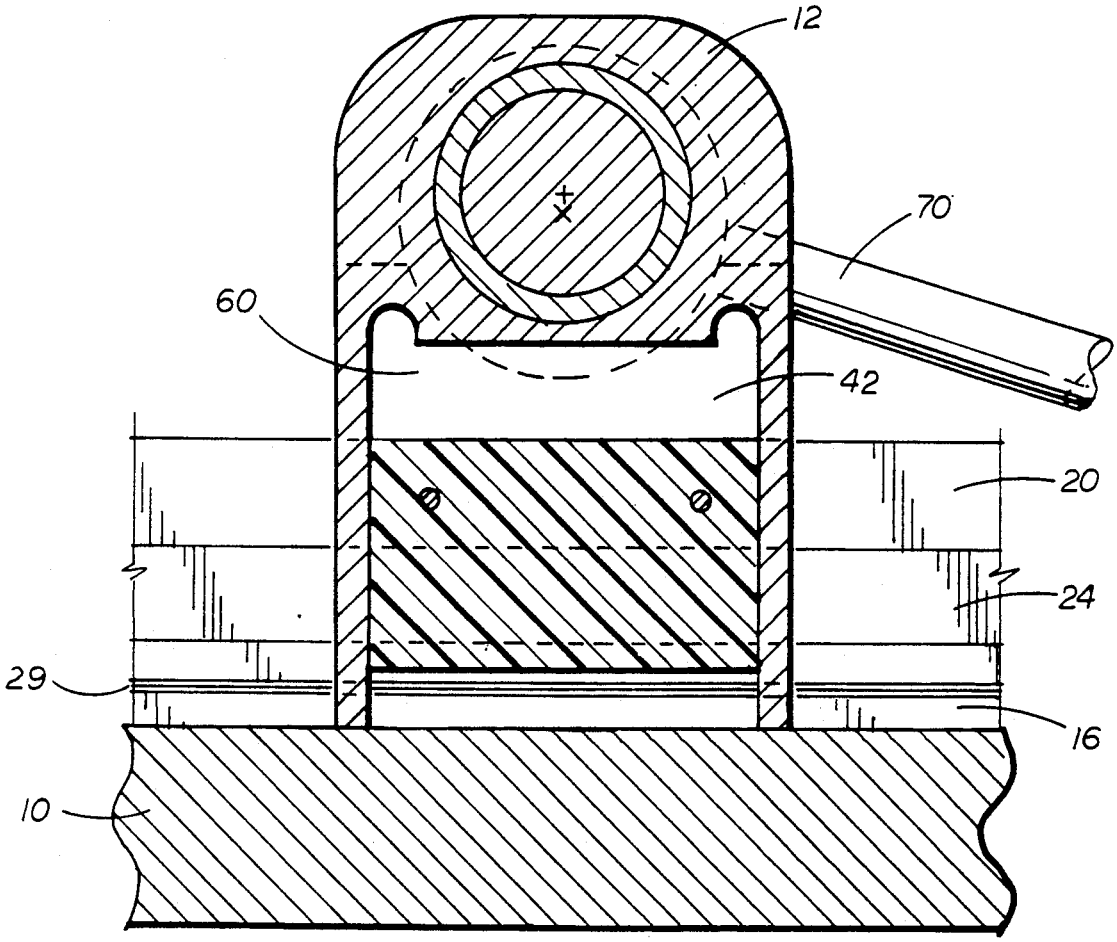
FIG. 5 is a vertical cross-sectional view of the press taken on lines V—V of FIG. 3.

The details of drive mechanism 22 are best illustrated in FIGS. 3, 4 and 5. As shown in FIG. 3, the drive mechanism includes a cylindrical shaft 30 positioned between side posts 12 and 14. A stub axle 32 extends from each end of the cylindrical shaft. The longitudinal axes of the cylindrical shaft is off set from a longitudinal axes of each stub axle approximately ⅛", and a longitudinal axes of the stub axle lie in the same line. Each side post includes an opening 34 in which is received an end bearing 36, which end bearing in turn receives and supports a stub axle 32. By this arrangement, the cylindrical shaft is supported for rotation by the end bearings in the side posts. Preferably the end bearings are capped to present a smooth outer surface, as shown for example in FIG. 1. Because of the off-set of the longitudinal axes of the cylindrical shaft and stub axles as the cylindrical shaft rotates its outer surface will rise and fall relative to the side posts a total distance of about ¼".

The cylindrical shaft 30 has positioned, along its length, a pair of bearings 40. Between each bearing and top plate 20 is a channel block 42. Each channel block includes a channel 43 that receives the outer race of its associated bearing 40. By virtue of this arrangement, each channel block is captured by its associated bearing. As the cylindrical shaft rotates, each channel block will be driven by its associated bearing over the top surface of top plate 20, moving back and forth a total distance of approximately ⅛". However, it will be prevented from moving from side to side, toward and away from the side posts, by virtue of the inner race of its associated bearing being fixed to the cylindrical shaft 30. The opposed surfaces of the channel block and the top plate have a teflon inserts 46 to minimize the friction between these two surfaces as the channel block slides over the top plate, and to minimize wear of one element relative to the other as the press is used.

A cover 50 arches over the cylindrical shaft. It includes a skirt 52 (FIG. 4) at each side, which skirts generally covers the sides of the channel block. This cover is attached front and back to each channel block by a pair of screws 54 (or equivalent means). The interior of the cover also includes a small foam pad 56 over each bearing; it rests on the outer race of its associated bearing. Because of this arrangement, as the cylindrical shaft is rotated in a direction to lift the pillow blocks, the engagement of pad 56 with its associated bearing and the cover causes the cover to lift the pillow blocks by screws 54; thereby holding this assembly together. As shown in FIGS. 3 and 5, each side post includes a channel 60. A guide bracket 62 is attached to the portion of the side edge of the top plate platen 20 that is exposed to channel 60. The bracket is sized relative to the channel to permit the top platen to slide up and down relative to the side posts, but to hold the platen in a plane that is perpendicular to the face of each side post, thereby assuring that the top platen will remain parallel to the bottom platen. Four screws 64 (see FIG. 4) loosely attach each pillow block to the top platen, the loose attachment permitting the pillow block to slide fore and aft relative to the platen. Thus, as the pillow blocks are being lifted by the cover 50 and cylindrical shaft 30, they in turn lift the top platen. Preferably the guide brackets are made of a plastic, such as Delron, that will slip easily within channel 60 with a minimum of friction.

A handle 70 is threaded into the cylindrical shaft and projects through transverse opening or slot 71 in cover 50. This handle includes at its outer end a grip 72, to permit the user of the press to move top platen towards and away from the bottom platen by manually rotating the handle from the position shown in FIG. 1 (at which the top platen is spaced from the bottom platen) to the position shown in FIG. 2 (at which the top platen has moved towards the bottom platen a distance sufficient to cause die 24 to cut the sheets between the die and the bottom platen). A stop bracket 76, shown in FIG. 4 for example, is attached to the central portion of the top platen. This stop bracket is generally U-shaped. Its upper edges are located, relative to the cylindrical shaft and its handle 70, to limit the movement of the handle to the arc defined between the positions shown in FIGS. 1 and 2.

Preferably the upper surface of base 10 includes a stepped area 82 of a reduced thickness for weight reduction. As shown in FIG. 2, this stepped area permits the user of the press to position die 24 by hand manipulation, and affords sufficient clearance between die 24 and step area 82 to receive the user's fingers.

With use and over time, it may be necessary to replace the bottom cutting pad 16. Because of that, preferably the front and rear edges of the cutting pad extend beyond the front and rear edges of the top platen sufficiently to allow easy access to the corner areas of the cutting pad, which cutting pad is screwed to base 10 by screws received in openings positioned in these corner areas.

In the construction shown in the drawings, it is preferred that the side posts and base be fabricated from aluminum, and the top platen from steel. The top platen should be sufficiently thick, for example at least ⅝" thick to ensure that the pressure applied to its upper surface by the channel blocks is evenly transmitted through the top platen to be uniformly distributed over the entire surface of the die 24 between the top platen and the cutting pad or bottom platen. In this fashion, as well as because of the construction of the press, a reasonably lightweight yet strong and durable unit is provided.

Various modifications in the press will be apparent to those skilled in this field. For that reason, the invention is not limited to the preferred construction of the press shown and described, but rather is set forth in the following claims.

We claim:

1. A sheet cutting die press including an upper platen, a lower platen, a support member holding the platens in a spaced, generally parallel relationship and permitting the platens to move relatively toward and away from one another, and means for moving the upper and lower platens relatively toward and away from one another, one of the upper and lower platens constituting a first platen, the other constituting a second platen, said means including a rotatable cam member adjacent to, but spaced from, the first platen, a bearing member of a predetermined width received about the cam member, the bearing member including an inner race attached to the cam member, a channel block means received between the cam member and the first platen to bear on and slide on the first platen, thereby to drive the first platen toward the second platen as the cam member rotates, the channel block means comprising a channel block having a groove formed therein to receive a portion of the outer race of the bearing member, the groove capturing the channel block between the first platen and the bearing member, whereby a sheet cutting die received between the platens may be employed to cut one or more sheets by causing the platens to move relatively towards one another.

2. A sheet cutting die press as set forth in claim 1 in which the means for moving the platens further includes a manual actuation member for rotating the cam member.

3. A sheet cutting die press as set forth in claim 2 in which the manual actuating member is a handle received in and projecting from the cam member.

4. A sheet cutting die press as set forth in claim 2 including a cover member partially surrounding the cam member and attached to the channel block, whereby as the cam member rotates to move the channel block away from the adjacent platen the cover member holds the channel block adjacent to the cam member.

5. A sheet cutting die press as set forth in claim 4 including a pad between the cover member and bearing member to hold the cam member a predetermined distance from the cover member.

6. A sheet cutting die press as set forth in claim 5 including means between the channel block and the first platen to minimize friction between the channel block and the first platen as the channel block moves on the first platen.

7. A sheet cutting die press as set forth in claim 1 in which the support member includes a base, at least two side posts, each post having an opening therein, the cam member having at each end a stub axle, two end bearings, each end bearing being received in the opening in a corresponding side post, the end bearings receiving the stub axles of the cam member, the side posts holding the cam member in a predetermined spaced relationship to the base.

8. A sheet cutting die press as set forth in claim 7 in which each of the side posts are spaced from one another and hold between them one of said platen members, the platen member being movable relative to the side posts toward and away from the base, and orientation means holding the movable platen substantially parallel to the bases as it moves relative to the side posts.

9. A sheet cutting die press as set forth in claim 8, the means for moving the platens further including a handle fixed to and projecting laterally from the cam member to permit the cam member to be manually rotated relative to the side posts, and a stop bracket positioned in the path of travel of the handle to limit the angular rotation of the handle to orientations between a first position in which the planes defined by the platens are spaced a maximum distance from one another and a second position in which the planes defined by the platens are spaced a minimum distance from one another.

10. A sheet cutting die press as set forth in claim 9 including a cover member partially surrounding the cam member and attached to the channel block, whereby as the cam member rotates to move the channel block away from the moveable platen member the cover member holds the channel block adjacent to the cam member, a pad between the cover member and the bearing member to hold the cam member a predetermined distance from the cover member, and means between the channel block and the first platen to minimize friction between the channel block and the first platen as the channel block moves on the first platen.

11. A sheet cutting die press as set forth in claim 10 in which the means to minimize friction includes a teflon pad between the channel block and the first platen.

* * * * *